US006766562B1

(12) United States Patent
Horn

(10) Patent No.: US 6,766,562 B1
(45) Date of Patent: Jul. 27, 2004

(54) EXTENDIBLE HINGE

(75) Inventor: John R. Horn, Dubuque, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 10/339,095

(22) Filed: Jan. 9, 2003

(51) Int. Cl.[7] ..... E05F 1/10; E05F 3/18

(52) U.S. Cl. ..... 16/281; 16/50; 49/386; 403/41; 403/113; 403/120; 403/229

(58) Field of Search ..... 16/54, 68, 50, 16/225, 277, 280, 281, 284; 403/41, 113, 120, 121, 145, 146, 166, 220, 225, 229; 49/386

(56) References Cited

U.S. PATENT DOCUMENTS 2,546,026 A * 3/1951 Coon ..... 174/86
4,299,058 A * 11/1981 Spaulding ..... 49/386
6,129,476 A * 10/2000 Berman et al. ..... 403/229

OTHER PUBLICATIONS

Rytec Corporation Product Line: Artec–High Speed Sliding Door, 2001.*
Rytec Corportation Product Line: Fast Fold—High Speed Folding Door, 2001.*

* cited by examiner

*Primary Examiner*—Thomas B. Will
*Assistant Examiner*—Tara L. Mayo
(74) *Attorney, Agent, or Firm*—Marshall, Gerstein & Borun LLP

(57) ABSTRACT

A door assembly includes a swinging door with an extendible hinge disposed along an inner edge of the door. The extendible hinge allows the door to pivot through a range of pivotal positions and, when necessary, allows the door to move through a range of extended positions. The pivotal positions allow the door to open and close normally across a doorway, while the extended positions help protect the door assembly from damage in the event the door is forced to swing beyond its pivotal positions. In some embodiments, the door includes a spring-tensioned chain that draws the inner edge of the door against an anchor attached to a side edge of the doorway. The flexibility of the chain allows the door to pivot, while the compliance of the chain's spring allows the door to shift away from its normal pivot point and move to various extended positions.

30 Claims, 4 Drawing Sheets

EXTENDIBLE HINGE

BACKGROUND OF THE INVENTION

1. Field of the Invention

The subject invention generally pertains to door hinges and more specifically to a hinge that can extend to provide the door with a greater range of motion.

2. Description of Related Art

Factories, warehouses and other industrial buildings often include two-way swinging doors with double-acting hinges that allow traffic to push the door open in either direction. The hinges often include some type of spring or cam mechanism that automatically returns the door to its central closed position.

For example, the weight of the door may be supported by a cam surface having a valley, wherein a cam follower (that supports the weight of the door) settles into the valley as the door closes. In other words, the cam follower settling into the valley is what closes the door. When the door opens, the cam follower rises out of the valley, which raises the door. To allow the door to rise, there needs to be a gap or some vertical clearance between the upper edge of the door and the head jamb of the doorframe. Since the size of the gap varies as the door swings, such a gap may be difficult to seal.

Regardless of whether a two-way door closes by a spring or cam mechanism, such doors can usually only swing 90-degrees in either direction from its closed position. Attempting to swing the door beyond that often forces the door up against the edge of the wall that holds the door hinges. This is particularly true when the thickness of the wall is wider than the hinge. Since the part of the door that hits the edge of the wall tends to be rather close to the hinged edge of the door, and the opening force is often directed more toward the distal or outer edge of the door, the resulting leverage or mechanical advantage often creates a tremendous prying force that can damage the door and its hinges.

A common scenario, for example, is a forklift truck driving through the doorway with the door hinges to the right of the truck. After passing through the doorway, the forklift immediately turns to the right. If the forklift turns too soon, the forklift may catch the distal edge of the open door and force the door to pivot well beyond its limit.

SUMMARY OF THE INVENTION

In some embodiments, a flexible elongate member held in tensions holds a pivotal door up against an anchor attached to a doorjamb of a doorway.

In some embodiments, a door pivots about a pivot point to swing through a range of pivotal positions. Subsequently, the door can move away from the pivot point to move through a range of extended positions.

In some embodiments, the door can swing open in either direction.

In some embodiments, an adjustment can vary the tension in the flexible elongate member.

In some embodiments, a resilient member places the flexible elongate member in tension.

In some embodiments, a door includes a cavity that contains some of the flexible elongate member.

In some embodiments, the weight of the door is supported by a pad that rests directly on the floor.

In some embodiments, a rotatable element couples a flexible elongate member to an anchor that is attached to a doorjamb.

In some embodiments, the flexible elongate member is a chain.

In some embodiments, the flexible elongate member is a strap.

In some embodiments, the flexible elongate member is a cable.

In some embodiments, a wear pad provides wear protection between the flexible elongate member and an edge of the door.

In some embodiments, a door experiences a restorative closing force that increases abruptly as the door moves from a first range of pivotal positions to an extended range of positions.

DESCRIPTION OF THE PREFERRED EMBODIMENT

Figure 1:
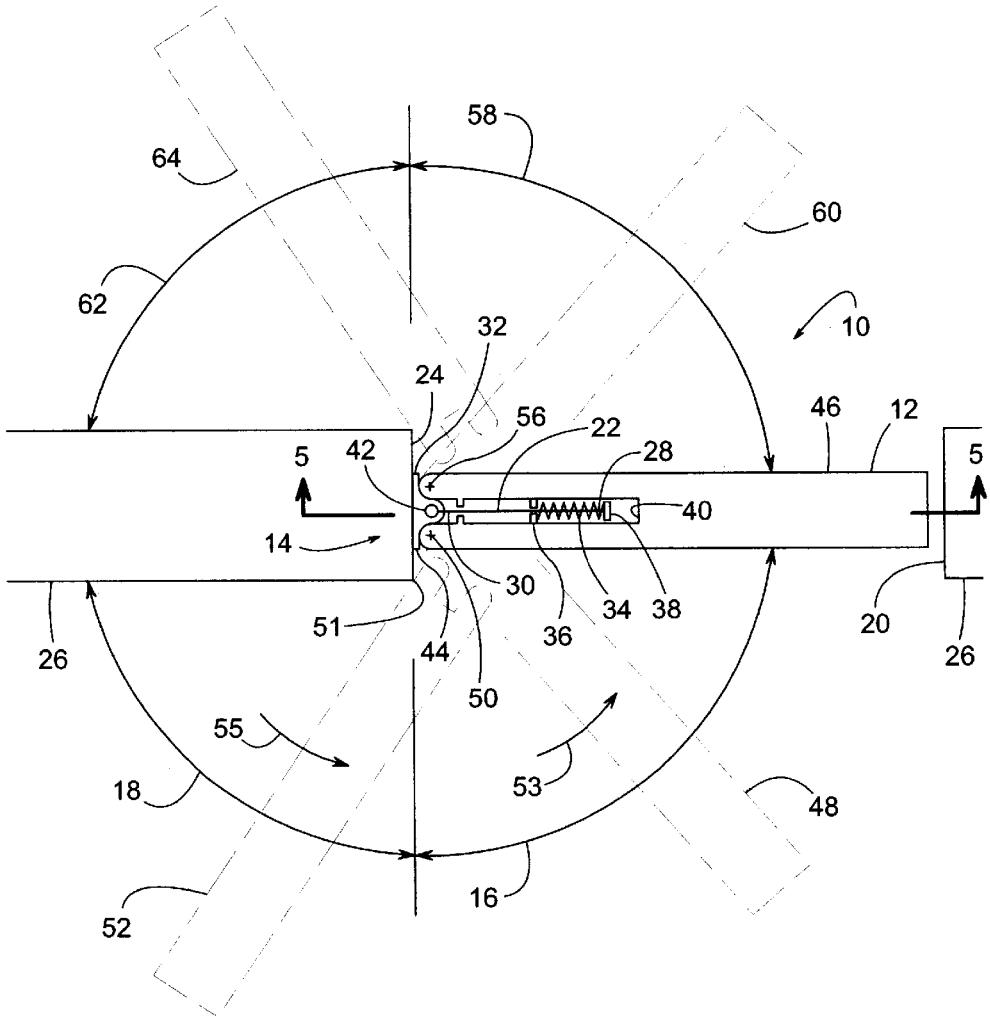
FIG. 1 is a schematic top view of a door showing the door's various ranges of motion.

FIG. 1 is a schematic top view of a door assembly 10 that includes a swinging door 12 with a hinge apparatus 14 that allows door 12 to pivot through a first range of pivotal positions 16 and further allows the door to move through a first range of extended positions 18. Pivotal positions 16 allow door 12 to open and close across a doorway 20, while extended positions 18 help protect door assembly 10 from damage in the event door 12 is forced to swing beyond pivotal positions 16.

To provide such functions, door assembly 10 includes a flexible elongate member 22 whose tension urges door 12 toward an inner edge 24 of a wall 26. In FIG. 1, flexible elongate member 22 is schematically illustrated to encompass a wide variety of such members including, but not limited to, a chain, cable, strap, cord (fixed length or elastic), rope, band, etc. Elongate member 22 has a first end 28 coupled to door 12 and a second end 30 coupled to an anchor 32 that is attached to wall 26.

To maintain elongate member 22 in tension a resilient member 34 couples elongate member 22 to door 12. In FIG. 1, resilient member 34 is schematically illustrated to encompass any member that can place elongate member 22 in tension. Examples of resilient member 34 include, but are not limited to, a compression spring, tension spring, torsion spring, gas spring, suspended deadweight, polymeric spring, stack of Bellville washers, etc.

In the case where resilient member 34 is a compression spring, resilient member 34 can be compressed between a stop plate 36 and an end piece 38. Stop plate 36 has an adjustable but otherwise fixed position relative to door 12, and end piece 38 is attached to end 28 of elongate member 22. For appearance and protection against damage, stop plate 36, end piece 38, resilient member 34, and elongate member 22 are preferably, but not necessarily, disposed within a cavity 40 of door 12.

Figure 2:
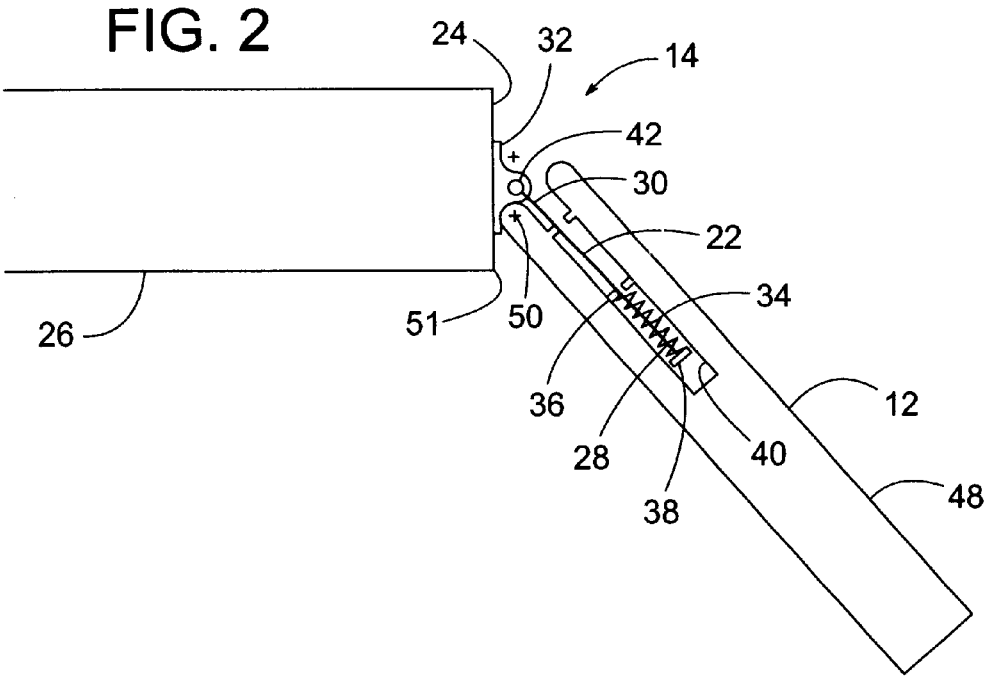
FIG. 2 is a schematic top view of a door showing the door at a pivotal position.

To provide elongate member 22 with more freedom of movement, end 30 of elongate member 22 connects to an element 42 that can rotate or pivot within a relatively fixed housing 44 of anchor 32. As door 12 pivots through its first range of pivotal positions 16, or as door 12 pivots from a closed position 46 to a first pivoted position 48 (FIG. 2), door 12 pivots about a first pivot point 50, while end 30 and element 42 rotate relative to housing 44.

Figure 3:
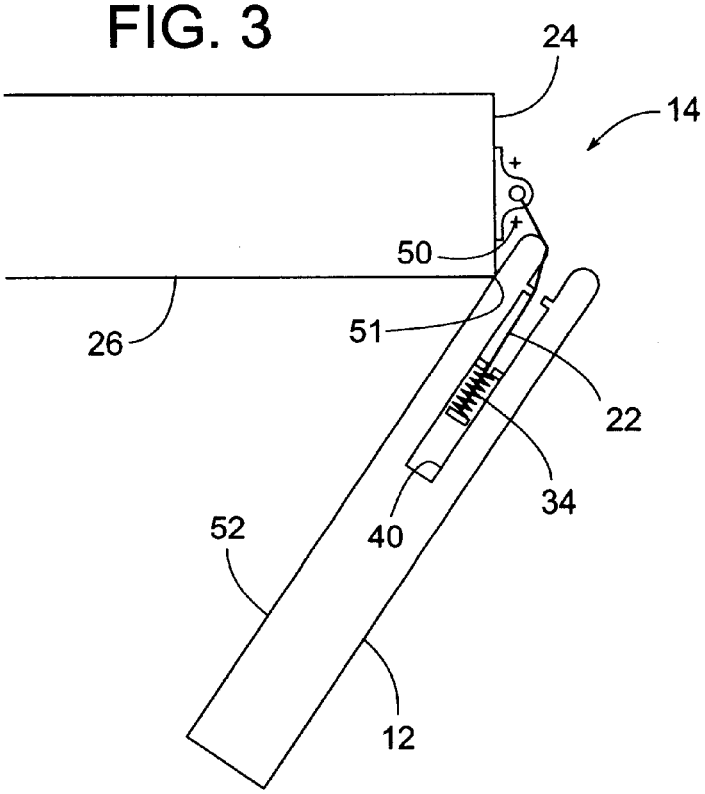
FIG. 3 is similar to FIG. 2, but showing the door at an extended position.

As door 12 opens further and enters the first range of extended positions 18, such as position 52 (FIG. 3), the side of door 12 may strike a corner of inner edge 24 of wall 26. This corner is identified as a second pivot point 51 in the drawing figures. As door 12 moves in the first range of extended positions 18, door 12 may pivot (and/or slide) about point 51, which displaces door 12 relative to pivot point 50. Such movement is made possible by resilient member 34 compressing, which feeds some of elongate member 22 out from within cavity 40. Changing the door's pivot point from point 50 to 51 increases the moment arm of the restorative closing torque applied to door 12. Thus, door 4 experiences a first restorative closing torque 53 in the first range of pivotal positions 16 and experiences a greater second restorative closing torque 55 in the first range of extended positions 18.

It should be noted that FIG. 1 illustrates just one example of ranges 16 and 18 and that other ranges with more or less rotation are possible, depending on the wall thickness and other factors.

In some cases, door 12 may be a two-way swinging door that can swing open in either direction. For example, in FIG. 1, door 12 is shown being able to pivot about another pivot point 56 to swing through a second range of pivotal positions 58, such as position 60. And door 12 is further able to move through a second range of extended positions 62, such as position 64 The pivot points 50 and 56 are horizontally spaced apart from each other to create a more stable closed position 46 for door 12. Regardless of which way door 12 opens, the operation is similar, with range 16, range 18 and pivot point 50 corresponding to range 58, range 62 and pivot point 56, respectively.

Figure 4:
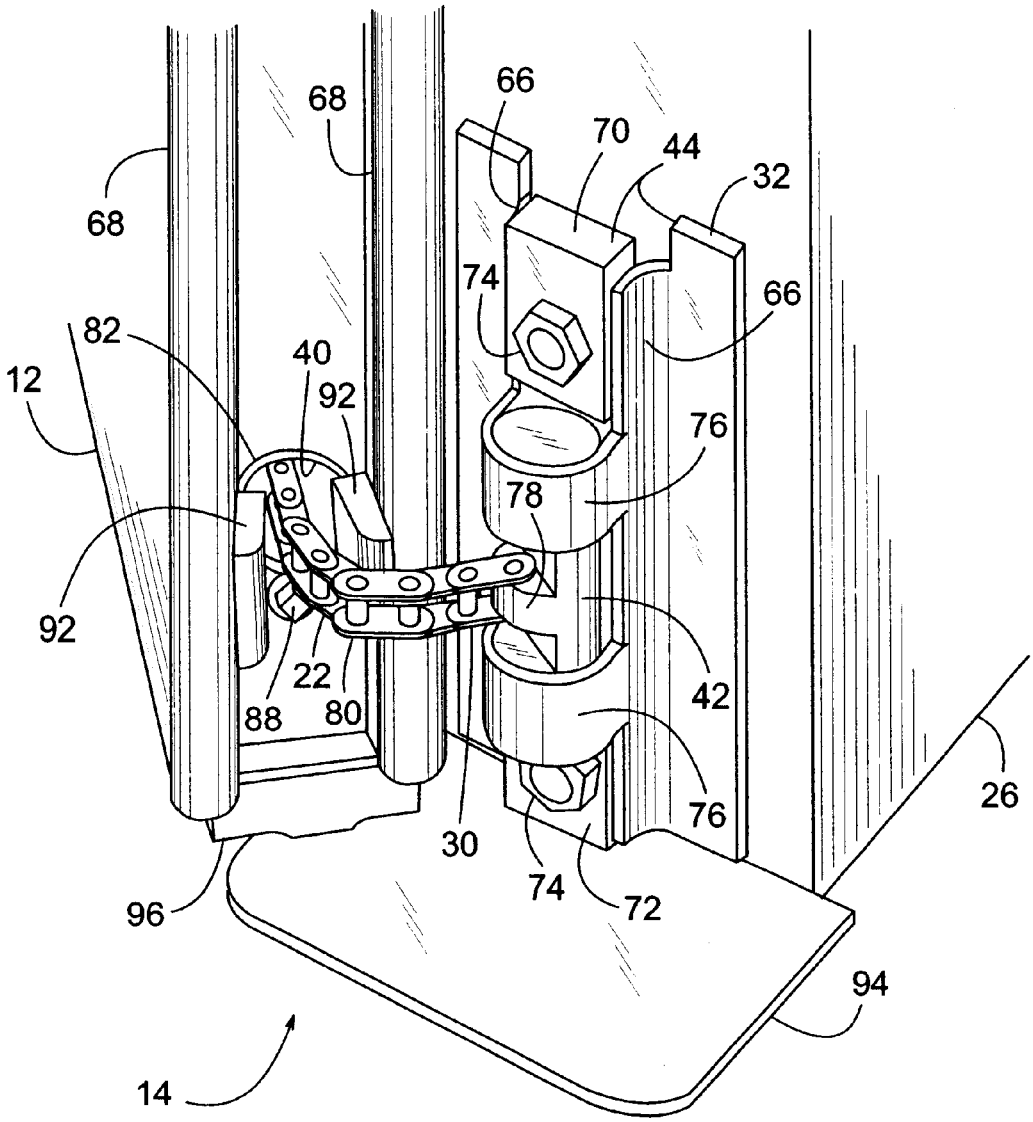
FIG. 4 is a perspective view of one embodiment of a door assembly whose door is at an extended position.
Figure 5:
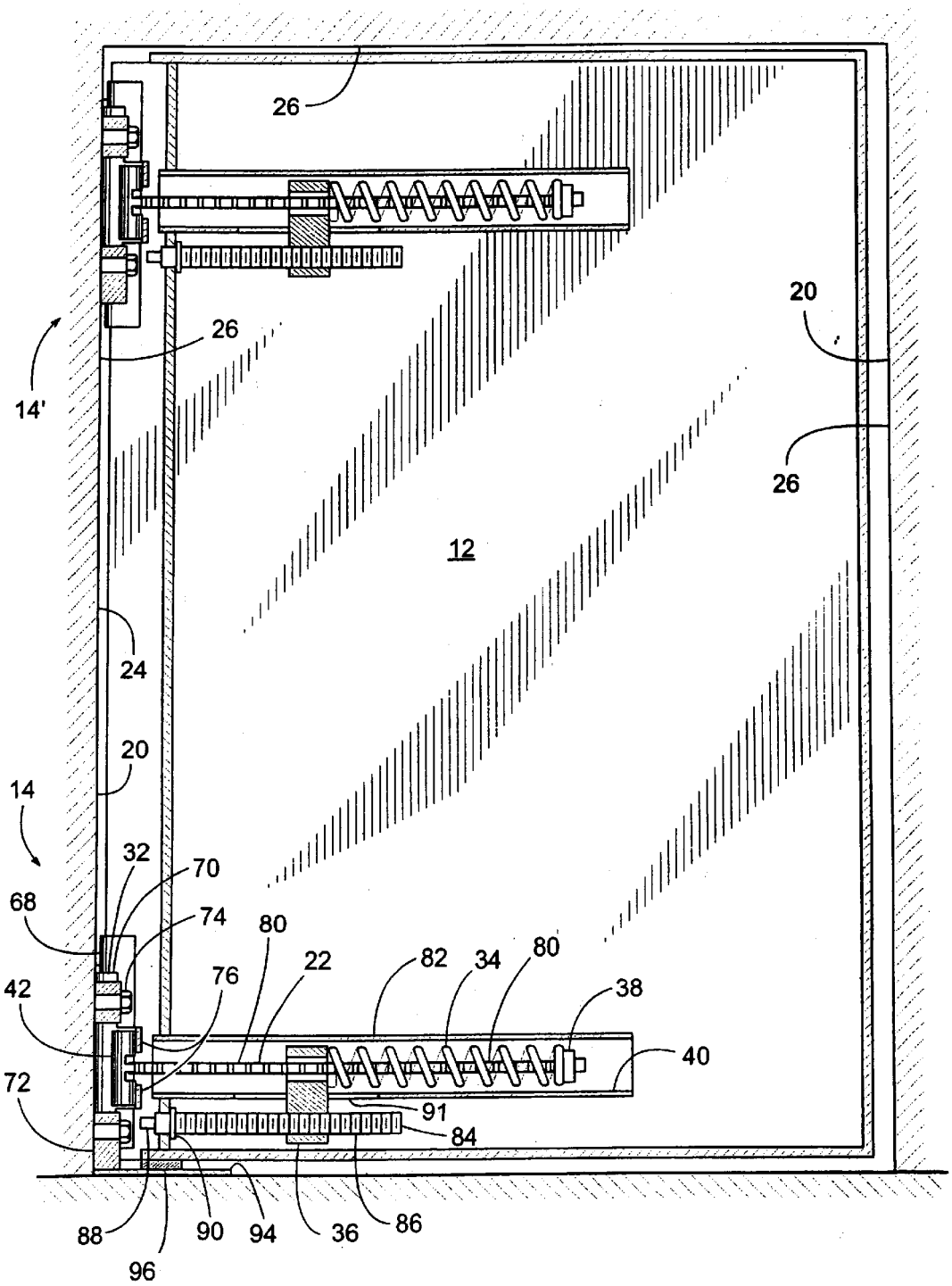
FIG. 5 is a cross-sectional view taken along line 5—5 of FIG. 1; however, the cross-sectional view is of a particular door assembly, rather than being schematic.

Additional structural and functional details of door assembly 12 are illustrated in the embodiment of FIGS. 4 and 5. In this example, housing 44 of anchor 32 includes two surfaces 66 that are curved to receive two pivot strips 68 for guiding the pivotal motion of door 12. Strips 68 are attached to the hinged edge of door 12 and can be made of ultra high molecular weight (UHMW) polyethylene to reduce friction and minimize wear. Anchor 32 includes mounting blocks 70 and 72 that receive anchor bolts 74 for fastening anchor 32 to wall 26. Anchor 32 includes straps 76, which contain element 42, but allow element 42 to rotate relative to housing 44. Element 42 is notched out to provide a flange 78 that connects to end 30 of a roller chain 80 (one example of flexible elongate member 22).

The other end 28 of chain 80 feeds through a tube 82 (example of cavity 40) inside of door 12. Chain 80 extends through stop plate 36, extends through compression spring 34, and terminates at end piece 38. As mentioned earlier spring 34 is compressed between stop plate 36 and end piece 38 to place tension on chain 80, whereby chain 80 urges door 12 toward anchor 32.

To adjust the tension in chain 80, door 12 is provided with an adjustment 84. In some embodiments, adjustment 84 comprises a shaft 86 that screws through an internally threaded hole in stop plate 36. Shaft 86 includes a head 88 for manually turning shaft 86 relative to stop plate 36. A flange 90 on shaft 86 holds the shaft at a relatively fixed axial position relative to door 12, so turning head 88 adjusts the stop plate's axial position on shaft 86. Stop plate 36 is able to slide along a slot 91 in tube 82, thus turning head 88 adjusts the stop plate's position within tube 82, thereby adjusting the compression of spring 34 and the tension of chain 80. Although adjustment 84 is shown mounted below tube 82, adjustment 84 can alternatively be mounted above tube 82 or at other locations.

Door assembly 10 can be provided with wear pads 92 for minimizing friction and wear between chain 80 and inner edges of door 12. Wear pads 92 can be made of UHMW polyethylene or other appropriate materials.

To provide door 12 with vertical support, a support pad 94 can be installed on the floor, underneath the door, such that the door rests on the pad. A support member 96 attached to the underside of door 12 can then slide along pad 94, as door 12 swings open and closed. Support pad 96 can be made of UHMW polyethylene or another appropriate wear resistant material. Pad 94 can be fastened to the floor, wall 26, or the underside of housing 44 using an appropriate fastener or adhesive. By placing pad 94 directly against the floor, the structure of the floor can provide door 12 with tremendous vertical support.

In addition to hinge apparatus 14, door 12 is preferably provided with one or more additional similar hinge apparatuses, such as hinge apparatus 14'.

Although the invention is described with reference to a preferred embodiment, it should be appreciated by those skilled in the art that various modifications are well within the scope of the invention. For example, although hinge apparatuses 14 and 14' each have their own separate pivot strips 68, the strips could be combined to create one long continuous pivot strip that runs the full height of the door. Likewise, the mating curved surfaces 66 of housing 44 could be lengthened in a similar manner. This could provide, between the pivot strip and the housing, a line of contact the runs continuously along the full height of the door, thereby minimizing any air gap where the door attaches to the wall. Therefore, the scope of the invention is to be determined by reference to the claims that follow.

I claim:

1. A door assembly attachable to a wall of a doorway, comprising:

an anchor attachable to the wall;

a door having a first range of pivotal positions and a first range of extended positions, wherein the door pivots about a first pivot point upon moving through the first range of pivotal positions, and the door becomes displaced relative to the first pivot point upon the door moving from the first range of pivotal positions to the first range of extended positions; and a flexible elongate member having a first end coupled to the door and a second end coupled to the anchor, wherein the flexible elongate member is in tension to urge the door toward the anchor.

2. The door assembly of claim 1, wherein the door has a second range of pivotal positions and a second range of extended positions, wherein the door pivots about a second pivot point upon moving through the second range of pivotal positions, and the door becomes displaced relative to the second pivot point upon the door moving from the second range of pivotal positions to the second range of extended positions, wherein the first pivot point and the second pivot point are horizontally spaced apart from each other.

3. The door assembly of claim 1, further comprising an adjustment coupled to the flexible elongate member, wherein manipulation of the adjustment varies the tension in the flexible elongate member.

4. The door assembly of claim 1, further comprising a resilient member coupled to the flexible elongate member to place the flexible elongate member in tension.

5. The door assembly of claim 4, wherein the resilient member is a compression spring.

6. The door assembly of claim 1, wherein the door defines a cavity into which the flexible elongate member extends.

7. The door assembly of claim 1, further comprising a support pad disposed underneath and engaging the door to provide the door with vertical support.

8. The door assembly of claim 7, wherein the door slides over the support pad.

9. The door assembly of claim 1 further comprising an element that couples the second end of the elongate member to the anchor, wherein the element is rotatably attached to the anchor.

10. The door assembly of claim 1, wherein the flexible elongate member is a chain.

11. The door assembly of claim 1, wherein the flexible elongate member is a strap.

12. The door assembly of claim 1, wherein the flexible elongate member is a cable.

13. The door assembly of claim 1, further comprising a wear pad disposed on the door and providing relative sliding engagement between the wear pad and the flexible elongate member.

14. The door assembly of claim 1, wherein the flexible elongate member exerts on the door a restorative closing torque that increases due to the door becoming displaced from the first pivot point, whereby the restorative closing torque is greater in the first range of extended positions than in the first range of pivotal positions.

15. A door assembly attachable to a wall of a doorway, comprising:

a door;

an anchor adapted to be attached to the wall;

a flexible elongate member having a first end coupled to the door and a second end coupled to the anchor;

a resilient member attached to the flexible elongate member such that the flexible elongate member and the resilient member draw the door toward the anchor; and a first pivotal joint between the door and the hinge anchor that enables the door to pivot from a closed position through a first range of pivotal positions, thereby defining a first pivot point; wherein the flexible elongate member and the resilient member render the door further moveable from the first range of pivotal positions through a first range of extended positions that displace the door relative to the first pivot point.

16. The door assembly of claim 15, wherein the door has a second range of pivotal positions and a second range of extended positions, wherein the door pivots about a second pivot point through the second range of pivotal positions, and the door is displaced relative to the second pivot point in the second range of extended positions, wherein the first pivot point and the second pivot point are horizontally spaced apart from each other.

17. The door assembly of claim 15, further comprising an adjustment coupled to the resilient member, wherein manipulation of the adjustment varies the tension in the flexible elongate member.

18. The door assembly of claim 15, wherein the resilient member is a compression spring.

19. The door assembly of claim 15, wherein the door defines a cavity and the resilient member is disposed inside the cavity.

20. The door assembly of claim 15, further comprising a support pad disposed underneath and engaging the door to provide the door with vertical support.

21. The door assembly of claim 20, wherein the door slides over the support pad.

22. The door assembly of claim 15, further comprising an element that couples the second end of the elongate member to the anchor, wherein the element is rotatably attached to the anchor.

23. The door assembly of claim 15, wherein the flexible elongate member is a chain.

24. The door assembly of claim 15, wherein the flexible elongate member is a strap.

25. The door assembly of claim 15, wherein the flexible elongate member is a cable.

26. The door assembly of claim 15, further comprising a wear pad disposed on the door and providing relative sliding engagement between the wear pad and the flexible elongate member.

27. Method of operating a door pivotally attached to a wall of a doorway, comprising:

applying a first restorative closing torque to the door while pivoting the door about a first pivot point; and applying a second restorative closing torque to the door while pivoting the door about a second pivot point, wherein the first pivot point is horizontally spaced apart from the second pivot point and the first restorative closing torque is less than the second restorative closing torque.

28. The method of claim 27, wherein the first restorative closing torque and the second restorative closing torque are created by applying tension to an elongate member that is coupled to the door.

29. The method of claim 28, further comprising adjusting the tension in the elongate member.

30. The method of claim 27, further comprising sliding the door across a wear pad that vertically supports the door.

* * * * *